US010919327B2

(12) United States Patent
Harada

(10) Patent No.: US 10,919,327 B2
(45) Date of Patent: Feb. 16, 2021

(54) THERMAL TRANSFER SHEET

(71) Applicant: Dai Nippon Printing Co., Ltd., Tokyo (JP)

(72) Inventor: Tomohiro Harada, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 145 days.

(21) Appl. No.: 16/332,553

(22) PCT Filed: Sep. 26, 2017

(86) PCT No.: PCT/JP2017/034726
§ 371 (c)(1),
(2) Date: Mar. 12, 2019

(87) PCT Pub. No.: WO2018/062171
PCT Pub. Date: Apr. 5, 2018

(65) Prior Publication Data

US 2020/0307294 A1 Oct. 1, 2020

(30) Foreign Application Priority Data

Sep. 30, 2016 (JP) ..... 2016-194283

(51) Int. Cl.
*B41M 5/40* (2006.01)
*B41M 5/382* (2006.01)
(Continued)

(52) U.S. Cl.
CPC ..... *B41M 5/38214* (2013.01); *B41M 5/426* (2013.01); *B41M 5/44* (2013.01)

(58) Field of Classification Search
CPC .... B41M 5/38214; B41M 5/426; B41M 5/44; B41M 2205/30; B41M 2205/36; B41M 5/42; B41M 5/395; B41M 5/40
See application file for complete search history.

(56) References Cited

U.S. PATENT DOCUMENTS 8,153,555 B2 * 4/2012 Ieshige ..... B41M 5/44 503/227
2009/0060132 A1 3/2009 Hosokawa et al.
(Continued)

FOREIGN PATENT DOCUMENTS

JP 09-011647 * 1/1997 ..... B41M 5/382
JP H11-020325 A1 1/1999
(Continued)

OTHER PUBLICATIONS

Machine translation of JP 09-011647, published on Jan. 1997 (Year: 1997).*

(Continued)

*Primary Examiner* — Huan H Tran
(74) *Attorney, Agent, or Firm* — Burr & Brown, PLLC

(57) ABSTRACT

To provide a thermal transfer sheet capable of inhibiting residues derived from a back face layer from adhering to a thermal head, also capable of inhibiting occurrence of a kick, and having a shorter time period until the back face layer is stabilized.

A thermal transfer sheet comprising; a colorant layer located on one surface of a substrate and a back face layer located on the other surface of the substrate, wherein the back face layer comprises a binder resin and inorganic particles, and the binder resin comprises a product obtained by reacting a polyisocyanate having an isocyanurate structure with a resin having hydroxyl groups at an equivalent ratio of isocyanate groups in the polyisocyanate having an isocyanurate structure to hydroxyl groups in the resin having hydroxyl groups (—NCO/—OH) of 0.05 or more and 0.15 or less.

4 Claims, 1 Drawing Sheet

(51) Int. Cl.
*B41M 5/42* (2006.01)
*B41M 5/44* (2006.01)

(56) References Cited

U.S. PATENT DOCUMENTS

| | | | | |
|---|---|---|---|---|
| 2011/0045213 | A1 | 2/2011 | Ieshige et al. | |
| 2014/0212604 | A1* | 7/2014 | Suzuki | B41M 5/44 428/32.66 |
| 2014/0242305 | A1* | 8/2014 | Muraki | B41M 5/44 428/32.67 |
| 2014/0340459 | A1 | 11/2014 | Fukunaga et al. | |

FOREIGN PATENT DOCUMENTS

| | | | |
|---|---|---|---|
| JP | 2000-272254 | A1 | 10/2000 |
| JP | 2009-073191 | A1 | 4/2009 |
| JP | 2009-286060 | A1 | 12/2009 |
| JP | 2010-158781 | A1 | 7/2010 |
| JP | 2011-168013 | A1 | 9/2011 |
| JP | 2012-006342 | A1 | 1/2012 |
| JP | 2015-063050 | A1 | 4/2015 |
| WO | 2008/038793 | A1 | 4/2008 |
| WO | 2013/118459 | A1 | 8/2013 |

OTHER PUBLICATIONS

International Search Report and Written Opinion (Application No. PCT/JP2017/034726) dated Nov. 21, 2017.
Korean Office Action (Application No. 10-2019-7009188) dated Nov. 18, 2020 (with English translation).

* cited by examiner

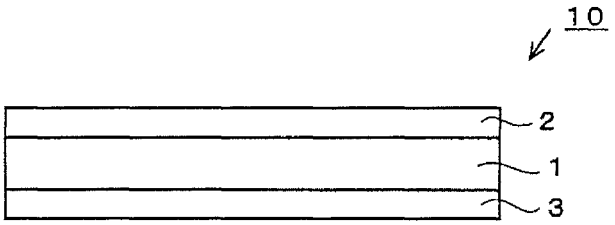
10
2
1
3

THERMAL TRANSFER SHEET

TECHNICAL FIELD

The present invention relates to thermal transfer sheets.

BACKGROUND ART

Various thermal transfer recording methods have been widely used as simple printing methods. In each thermal transfer recording method, a thermal transfer sheet has been mainly used in which colorant layers of, for example, yellow, magenta, and cyan (and black, if necessary) are repeatedly and numerously provided on a continuing substrate, as being frame sequentially. The thermal transfer recording method may be broadly divided into two methods: a melt type recording method in which colorant layers are melted and softened by heating and allowed to migrate onto a transfer receiving article to form an image; and a sublimation type recording method in which dyes in colorant layers are allowed to migrate onto a transfer receiving article by heating to form an image. Among these, the sublimation type recording method, which excels in reproducibility and gradation of halftone because sublimable dyes are used as colorants, enables full-color image to be clearly expressed as the original image on an image receiving sheet. Thus, this method has been applied in color image formation for digital cameras, video recorders, computers or the like. The images have a high quality, comparable to silver halide photography.

In the case of printing on a large number of thermal transfer sheets, components in the back face layer of the thermal transfer sheet fall off to remain as so-called "residues". Alternatively, components fallen off are baked by the heat from a thermal head heating element to become "residues", which may adhere onto the heating element of the thermal head or onto the vicinity thereof. When the amount of these "residues" increases, the "residues" are pressed onto the thermal transfer sheet in printing and then, the traces thereof are printed even on the side of the transfer receiving article, appearing as "flaws" on an image formed on the transfer receiving article in some cases. Although development for inhibiting occurrence of "flaws" caused by "residues" falling off from the back face layer of thermal transfer sheets has advanced, the solution therefor has not yet been reached.

A thermal transfer sheet is generally stored in a wound around state at a predetermined winding diameter. In the case where a colorant contained in the colorant layer is present localizedly on the surface of the colorant layer due to bleeding or the like, the colorant is likely to migrate (so-called, to be kicked) to the side of the back face layer of the thermal transfer sheet. Then, in the case where the colorant that has migrated to the side of the back face layer remigrates (so-called, backs) to the side of the colorant layer again, particularly in the case where, in a thermal transfer sheet in which colorant layers of colors each having a different hue are provided as being frame sequentially, a colorant that has migrated to the side of the back face layer migrates to a different colorant layer having a different hue from that of the colorant, the color developing characteristics may be degraded in image formation by use of the different colorant layer.

Under such circumstances, various studies have been conducted on thermal transfer sheets for inhibiting occurrence of a kick. For example, Patent Literature 1 has proposed a thermal transfer sheet in which a dye layer is provided on one surface of a substrate and a back face layer is provided on the other side of the substrate, wherein the dye layer contains a predetermined dye and a binder resin. According to this thermal transfer sheet, it is said that migration of a dye to the side of the back face layer can be prevented while the thermal transfer sheet is stored. The thermal transfer sheet proposed in Patent Literature 1, however, has an inherent problem of a narrow range of materials to be selected, because dye types and binder resin types to be contained in the dye layer are limited to predetermined components.

As mentioned above, a thermal transfer sheet is stored in a wound around state at a predetermined winding diameter. In the case where the thermal transfer sheet is wound around while the back face layer constituting the thermal transfer sheet is insufficiently cured, the back face layer closely adheres to the colorant layer during storage, and a defect may occur during printing. Thus, when the thermal transfer sheet is wound around, so-called aging treatment has to be conducted until the back face layer is completely cured and stabilized. Reduction in the aging time is also required.

CITATION LIST

Patent Literature

Patent Literature 1: Japanese Patent Laid-Open No. 2009-286060

SUMMARY OF INVENTION

Technical Problem

The present invention has been made under such circumstances, and the present invention aims principally to provide a thermal transfer sheet capable of inhibiting residues, which are resulted by falling off of components from a back face layer or by baking of the fallen-off components thereafter, from adhering onto a thermal head, capable of inhibiting occurrence of a so-called kick, and having a shorter time period until the back face layer is stabilized.

Solution to Problem

The present invention for solving the above problem is a thermal transfer sheet comprising; a colorant layer located on one surface of a substrate and a back face layer located on the other surface of the substrate, wherein the back face layer comprises a binder resin and inorganic particles, and the binder resin comprises a product obtained by reacting a polyisocyanate having an isocyanurate structure with a resin having hydroxyl groups at an equivalent ratio of isocyanate groups in the polyisocyanate having an isocyanurate structure to hydroxyl groups in the resin having hydroxyl groups (—NCO/—OH) of 0.05 or more and 0.15 or less.

In the thermal transfer sheet of the present invention, the polyisocyanate having an isocyanurate structure may be a polyisocyanate obtained by polymerizing isocyanate monomers with a cyclic structure having 9 or more carbon atoms.

In thermal transfer sheet of the present invention, the inorganic particles may be non-spherical inorganic particles and may be contained at 5% by mass or more on the basis of the total mass of the back face layer.

Advantageous Effects of Invention

According to the thermal transfer sheet of the present invention, it is possible to inhibit residues, which are resulted by falling off of components from a back face layer or by baking of the fallen-off components thereafter, from adhering onto a thermal head, to effectively inhibit occurrence of a so-called kick, and to make the aging time for the back face layer shorter than that of conventional ones.

BRIEF DESCRIPTION OF DRAWING

FIG. 1 is a schematic sectional view showing an example of the thermal transfer sheet of the present invention.

DESCRIPTION OF EMBODIMENTS

Hereinafter, a thermal transfer sheet of an embodiment of the present invention will be described in detail using a drawing. In the drawing, for the sake of illustration and easier understanding, scales, horizontal to vertical dimensional ratios and the like are exaggeratingly modified from those of the real things.

FIG. 1 is a schematic sectional view showing an example of the thermal transfer sheet of the present invention.

As shown in FIG. 1, in a thermal transfer sheet 10 according to the embodiment of the present invention, a colorant layer 2 is located on one surface of a substrate 1 (the upper surface in FIG. 1), and a back face layer 3 is located on the other surface of the substrate 1 (the lower surface in FIG. 1).

The thermal transfer sheet 10 according to the embodiment of the present invention is not limited to the configuration shown in FIG. 1. For example, a dye primer layer, which is not shown, may be provided between the substrate 1 and the colorant layer 2. Additionally, on the upper surface of the substrate 1, a protective layer may be formed as being frame sequentially with respect to the colorant layer 2, and additionally, a release layer may be provided between the protective layer and the substrate 1, although the protective layer and the release layer are not shown. Additionally, a back face primer layer, although not shown, may be provided between the substrate 1 and the back face layer 3. The colorant layer 2 can take a configuration in which a plurality of colorant layers each having a different hue, for example, a yellow colorant layer, a magenta colorant layer, and a cyan colorant layer are provided, as being frame sequentially.

Hereinafter, each constituent of the thermal transfer sheet 10 will be concretely explained.

(Substrate)

The substrate 1, which is an essential constituent in the thermal transfer sheet 10 according to the embodiment of the present invention, is provided to retain the colorant layer 2 to be provided on one surface thereof and the back face layer 3 to be provided on the other surface thereof. Although there is no particular limitation on the material of the substrate 1, the material is desirably resistant to heat to be applied by a thermal head in transferring the colorant layer 2 onto a transfer receiving article and has mechanical properties so as to be handled without a hitch. As the substrate like this, various plastic films or sheets of: polyesters such as polyethylene terephthalate, polyarylate, polycarbonate, polyurethane, polyimide, polyetherimide, cellulose derivatives, polyethylene, ethylene-vinyl acetate copolymers, polypropylene, polystyrene, acryl, polyvinyl chloride, polyvinylidene chloride, polyvinyl alcohol, polyvinyl butyral, nylon, polyetheretherketone, polysulfone, polyethersulfone, tetrafluoroethylene-perfluoroalkyl vinyl ether copolymers, polyvinyl fluorides, tetrafluoroethylene-ethylene copolymers, tetrafluoroethylene-hexafluoropropylene copolymers, polychlorotrifluoroethylene, and polyvinylidene fluoride may be enumerated. The thickness of the substrate 1 may be appropriately set depending on the type of the material, so that the strength and heat resistance of the substrate lie in appropriate ranges. The thickness is generally about 0.2 μm or more and 100 μm or less and preferably 1 μm or more and 10 μm or less.

(Back Face Layer)

The back face layer 3, which is also an essential constituent in the thermal transfer sheet 10 according to the embodiment of the present invention, is provided on the one surface of the substrate 1 (the lower surface in FIG. 1). The back face layer 3 contains a binder resin and inorganic particles.

Binder Resin

The binder resin constituting the back face layer 3 contains a product obtained by reacting a polyisocyanate having an isocyanurate structure with a resin having hydroxyl groups. The product is a product obtained by a reaction at an equivalent ratio of isocyanate groups in the polyisocyanate having an isocyanurate structure to hydroxyl groups in the resin having hydroxyl groups (—NCO/—OH) (hereinafter, it may be noted as the "molar equivalent ratio (—NCO/—OH)") of 0.05 or more and 0.15 or less.

Employing the polyisocyanate having an isocyanurate structure as a so-called curing agent or crosslinking agent and setting the molar equivalent ratio (—NCO/—OH) within a predetermined range can inhibit adhesion of residues falling off from the back face layer onto a thermal head, inhibit occurrence of a so-called kick, and shorten the aging time.

The term "polyisocyanate having an isocyanurate structure" herein refers to a cyclic oligomer of isocyanate, and is more preferably a cyclic dimer or cyclic trimer.

As isocyanates constituting the polyisocyanate having an isocyanurate structure, for example, trimethylene diisocyanate, tetramethylene diisocyanate, pentamethylene diisocyanate, hexamethylene diisocyanate, and trimethylhexamethylene diisocyanate may be enumerated.

There is no particular limitation on isocyanate monomers constituting the polyisocyanate having an isocyanurate structure. Isocyanate monomers with a cyclic structure having 9 or less carbon atoms are preferably used. Use of isocyanate monomers with a cyclic structure having 9 or less carbon atoms as a raw material can effectively inhibit residues that may result from friction against a thermal head from adhering onto the thermal head.

There is no particular limitation on the method for producing such a polyisocyanate having an isocyanurate structure, and the polyisocyanate can be produced by a conventional method.

The mass average molecular weight of the polyisocyanate having an isocyanurate structure is selected within a range of usually 100 or more and 100,000 or less and preferably 500 or more and 10,000 or less. In the present invention, the mass average molecular weight is a value calculated in terms of polystyrene standard by means of Gel Permeation Chromatography (GPC method) in compliance with JIS K 7252-1: 2008.

As commercially available polyisocyanates having an isocyanurate structure, TAKENATE® D-204, D-204EA-1, D-262, D-268, D-251NL, D-170, D-170HN, D-172N, D-177N, and D-127N manufactured by Mitsui Chemicals, Inc. may be enumerated.

Meanwhile, as the "resin having hydroxyl groups" constituting the binder resin together with polyisocyanate having an isocyanurate structure, phenol resins, polyvinyl acetal, polyvinyl butyral, phenoxy resins, cellulose, and, acrylic resins may be enumerated. Among the above resins, resins having a Tg of 90° C. or more are more preferable.

Herein, in the thermal transfer sheet 10 according to the embodiment of the present invention, when a product is obtained by reacting a polyisocyanate having an isocyanurate structure with a resin having hydroxyl groups, the reaction is conducted at a molar equivalent ratio (—NCO/—OH) of 0.05 or more and 0.15 or less. When the molar equivalent ratio is set within the above numerical range, the performance of the back face is developed even with a short aging time, residues derived from the back face layer components are unlikely to be deposited near the heating element of a thermal head after a large number of prints are made. Additionally, occurrence of a kick can be inhibited. The molar equivalent ratio (—NCO/—OH) is more preferably 0.05 or more and 0.13 or less.

In the thermal transfer sheet 10 according to the embodiment of the present invention, the mass proportion of a product obtained by reacting the polyisocyanate having an isocyanurate structure with the resin having hydroxyl groups is preferably 40% by mass or more and 60% by mass or less on the basis of the total mass of the back face layer 3. When the mass proportion of the product is set at 40% by mass or more, it is possible to sufficiently exert a desired action and effect. When the mass proportion is set at 60% by mass or less, it is possible to allow a slip agent, inorganic particles and the like mentioned below to be contained in a desired amount, and thus, to achieve action and effect to be exerted by these slip agent and inorganic particles.

Inorganic Particles

The back face layer 3 in the thermal transfer sheet 10 according to the embodiment of the present invention contains inorganic particles in addition to the binder resin. The inorganic particles are contained in order to impart constant friction to the back face layer 3 on non-printing to thereby remove residues that have adhered to the thermal head. As such inorganic particles, carbon black, silica, alumina, titanium dioxide, molybdenum disulfide, talc, calcium carbonate, and mica may be enumerated. The shape thereof may be any shape such as spherical, non-spherical, acicular, and polygonal shapes. The shape is preferably non-spherical because it is possible to scrape off residues when friction against the thermal head results in the residues. There is not particular limitation on the size of the inorganic particles. For example, the particle size is preferably about 0.1 μm or more and 15 μm or less and more preferably about 1 μm or more and 10 μm or less.

There is also not particular limitation on the content of the inorganic particles. The organic particles are preferably contained in the range of 5% by mass or more and 10% by mass or less on the basis of the total mass of the back face layer 3. When the content of the inorganic particles is set at 5% by mass or more, it is possible to satisfactorily achieve an ability to scrape off the residues. When the content is set at 10% by mass or less, it is possible to accomplish the glossiness of a print.

Other Components

The back face layer 3 in the thermal transfer sheet 10 according to the embodiment of the present invention may contain components other than the "product obtained by reacting a polyisocyanate having an isocyanurate structure with a resin having hydroxyl groups" and "inorganic particles" mentioned above.

For example, in addition to the "product obtained by reacting a polyisocyanate having an isocyanurate structure with a resin having hydroxyl groups", other optional binder resin may be contained. Concretely, cellulosic resins, polyester type resins, polyacrylic ester type resins, polyvinyl acetate type resins, styrene acrylate type resins, polyurethane type resins, polyethylene type resins, polypropylene type resins, polystyrene type resins, polyvinyl chloride type resin, polyether type resin, polyamide type resins, polyimide type resins, polyamide imide type resin, polycarbonate type resin, polyacrylamide resins, polyvinyl chloride resin, polyvinyl butyral resins, polyvinyl acetoacetal resins, and silicone modified forms of these may be enumerated. When an optional binder resin is contained, the content thereof is preferably about 15% by mass or less on the basis of the total mass of the back face layer 3. Among those described above, when an appropriate amount of a polyamide imide type resin is contained, it is possible to improve the heat resistance. When an appropriate amount of a cellulosic resin is contained, it is possible to improve the film forming property.

The back face layer 3 may also contain various slip agents in addition to the "inorganic particles". Concretely, (poly) glycerol esters of fatty acids, metal soaps, fatty acid amides as fatty acid derivatives, graphite powders, fluorine type graft polymers, silicone polymers such as silicone oils, silicone type graft polymers, acrylic silicone graft polymers, acrylic siloxane, and aryl siloxane, and polyethylene waxes may be enumerated. The content of the slip agent like this is contained, the content thereof is preferably about 30% by mass or more and 40% by mass or less on the basis of the total mass of the back face layer 3. Among those described above, solid slip agents such as metal soaps can inhibit a kick more effectively than liquid slip agents.

There is no particular limitation on the method of forming the back face layer 3. The back face layer 3 may be formed by dispersing or dissolving a "product obtained by reacting a polyisocyanate having an isocyanurate structure with a resin having hydroxyl groups" as the binder resin, which is an essential constituent, "inorganic particles", and other binder resin and slip agent component to be added if necessary into a suitable solvent to prepare a coating liquid for back face layer, coating the coating liquid onto the substrate 1 by a conventional method, such as the gravure printing method, the screen printing method, and the reverse roll coating printing method using a gravure plate, and then drying the coated liquid. This also applies to coating methods of various coating liquids to be described below. The thickness of the back face layer 3 is preferably 3 μm or less and more preferably 0.1 μm or more and 2 μm or less in the dried state, from the viewpoint of improvement in the heat resistance and the like.

(Colorant Layer)

As shown in FIG. 1, the colorant layer 2 is provided on at least a portion of one surface of the substrate 1 (the upper surface in FIG. 1). The thermal transfer sheet 10 according to the embodiment of the present invention is not limited to the aspect shown. For example, a colorant layer 2 containing a sublimable dye and a colorant layer 2 containing thermally-fusible ink constituted by a thermally-fusible composition containing a coloring agent may be provided, as being frame sequentially, on one continuous substrate.

This colorant layer 2 is a colorant layer containing a sublimable dye in the case where the thermal transfer sheet of the present invention is a sublimable type thermal transfer sheet, and is a colorant layer containing thermally-fusible ink constituted by a thermally-fusible composition containing a coloring agent in the case where the thermal transfer sheet of the present invention is a fusible type thermal transfer sheet.

In the case where the thermal transfer sheet 10 of the present invention is a sublimable type thermal transfer sheet, as a material constituting the colorant layer 2, conventionally known sublimable dyes can be used. Preferable are sublimable dyes having satisfactory properties as a printing material, for example, sublimable dyes having sufficient coloring density and undergoing no discoloration or fading due to light, heat, temperature, or the like. Diarylmethane type dyes, triarylmethane type dyes, thiazole type dyes, merocyanine dyes, pyrazolone dyes, methine type dyes, indoaniline type dyes, azomethine type dyes such as acetophenoneazomethine, pyrazoloazomethine, imidazoleazomethine, imidazoazomethine, and pyridoneazomethine, xanthene type dyes, oxazine type dyes, cyanostyrene type dyes such as dicyanostyrene and tricyanostyrene, thiazine type dyes, azine type dyes, acridine type dyes, benzenazo type dyes, azo type dyes such as pyridonazo, thiophenazo, isothiazoleazo, pyrroleazo, pyrazoleazo, imidazoleazo, thiadiazoleazo, triazoleazo, and disazo, spiropyran type dyes, indolinospiropyran type dyes, fluoran type dyes, rhodamine-lactam type dyes, naphthoquinone type dyes, anthraquinone type dyes, and quinophthalone type dyes may be enumerated. Concretely, red dyes such as Disperse Red 60, Disperse Violet 26, Ceres Red 7B (Bayer AG), and Samaron Red F3BS (Mitsubishi Chemical Corporation), yellow dyes such as Disperse Yellow 231, PTY-52 (Mitsubishi Chemical Corporation), and Macrolex yellow 6G, and blue dyes such as Solvent Blue 63, Waxoline blue AP-FW (ICI), Holon brilliant blue S-R (Clariant), MS blue 100 (Mitsui Toatsu Chemicals, Inc.), and C.I. solvent blue 22 may be enumerated.

As the binder resin to carry the dye described above, cellulosic resins such as ethyl cellulose resins, hydroxyethyl cellulose resins, ethyl hydroxy cellulose resins, methyl cellulose resins, and cellulose acetate resins, vinyl type resins such as polyvinyl alcohol resins, polyvinyl acetate resins, polyvinyl butyral resins, polyvinyl acetal resins, and polyvinyl pyrrolidone, acrylic resins such as poly(meth)acrylate and poly(meth)acrylamide, polyurethane type resins, polyamide type resins, and polyester type resins may be enumerated. Among these, resins such as cellulosic, vinyl type, acrylic type, polyurethane type, and polyester type resins are preferable from the viewpoint of heat resistance, dye migration and the like.

The colorant layer 2 may contain additives such as inorganic particles and organic particles. As the inorganic particles, carbon black, silica, alumina, titanium dioxide, and molybdenum disulfide may be enumerated. As the organic particles, polyethylene waxes may be enumerated. The colorant layer 2 may also contain a release agent. As the release agent, silicone oils, phosphoric esters, and fluorine type materials may be enumerated. The colorant layer 2 may also contain various curing agents such as isocyanates, epoxy resins, and carbodiimide.

Meanwhile, in the case where the thermal transfer sheet 10 of the present invention is a fusible type thermal transfer sheet, the colorant layer 2 contains a thermally-fusible ink and a binder resin. The coloring agent contained in the thermally-fusible composition constituting the thermally-fusible ink may be appropriately selected from known organic and inorganic pigments or dyes. For example, preferable are coloring agents having sufficient coloring density and undergoing no discoloration or fading due to light, heat, or the like. The color of the thermally-fusible ink is not limited to cyan, magenta, yellow, and black, and coloring agents of various colors may be used.

As the binder resin contained in the colorant layer 2 of the fusible type thermal transfer sheet, for example, an ethylene-vinyl acetate copolymer, an ethylene-acrylic acid ester copolymer, polyethylene, polystyrene, polypropylene, polybutene, a petroleum resin, a vinyl chloride resin, a vinyl chloride-vinyl acetate copolymer, polyvinyl alcohol, a vinylidene chloride resin, an acrylic resin, a methacrylic resin, polyamide, polycarbonate, a fluorine resin, polyvinyl formal, polyvinyl butyral, acetyl cellulose, nitro cellulose, polyvinyl acetate, polyisobutylene, ethyl cellulose, or polyacetal may be used.

The colorant layer 2 of the fusible type thermal transfer sheet may also contain microcrystalline wax, carnauba wax, paraffin wax, or the like. Furthermore, Fischer-Tropsch wax, various low-molecular-weight polyethylenes, Japan wax, beeswax, spermaceti, insect wax, wool wax, shellac wax, candelilla wax, petrolatum, polyester wax, partially-modified wax or a wax component such as an ester of fatty acid and fatty acid amide may be contained.

There is no particular limitation on the content of the sublimable dye or the coloring agent contained in the colorant layer 2. The content is only required to be appropriately set in consideration of the printing density, storage stability and the like, depending on the type of sublimable dye or coloring agent to be used and the type of binder resin. For example, the sublimable dye is preferably contained in the range of 15% by mass or more and 300% by mass or less in the colorant layer 2, on the basis of the total mass of the binder resin contained in the colorant layer 2.

The colorant layer 2 may be formed by adding a dye or pigment and various additives to be added if necessary to an appropriate binder resin, dispersing or dissolving the binder resin including the dye or pigment and additives into an appropriate solvent such as toluene, methyl ethyl ketone, ethanol, isopropyl alcohol, cyclohexane, dimethylformamide, and water to prepare a coating liquid, coating the coating liquid onto the substrate 1 or an optional layer provided on the substrate 1, and then drying the coated liquid.

(Dye Primer Layer)

When the thermal transfer sheet 10 of the present invention is a sublimable type thermal transfer sheet, a dye primer layer (not shown) may be provided between the substrate 1 and the colorant layer 2. There is no particular limitation on the components contained in the dye primer layer. Polyester type resins, polyvinyl pyrrolidone resins, polyvinyl alcohol resins, hydroxyethyl cellulose, polyacrylic acid ester type resins, polyvinyl acetate type resins, polyurethane type resins, acryl-styrene type copolymers, polyacrylamide type resins, polyamide type resins, polyether type resins, polystyrene type resins, polyethylene type resins, polypropylene type resins, polyvinyl chloride resins, and polyvinyl acetal type resins such as polyvinyl acetoacetal and polyvinyl butyral may be enumerated.

The dye primer layer may also contain colloidal inorganic pigment ultrafine particles. As the colloidal inorganic pigment ultrafine particles, for example, silica (colloidal silica), alumina or hydrated alumina (alumina sol, colloidal alumina, cationic aluminum oxide or hydrates thereof, and psuedoboehmite), aluminum silicate, magnesium silicate, magnesium carbonate, magnesium oxide, and titanium oxide may be enumerated. Particularly, colloidal silica and alumina sol are preferably used. It is preferable that these colloidal inorganic pigment ultrafine particles have a size, as a primary average particle size, of 100 nm or less and more preferably 50 nm or less.

There is also no particular limitation on the method of forming the dye primer layer. The dye primer layer may be formed by dispersing or dissolving the components exemplified above and additives to be added if necessary into a suitable solvent to prepare a coating liquid for dye primer layer, coating this coating liquid onto the substrate 1, and then drying the coated liquid. There is not particular limitation on the thickness of the dye primer layer. The thickness is usually in the range of 0.02 μm or more and 1 μm or less.

EXAMPLES

Next, the present invention will be described more concretely with reference to Examples and Comparative Examples. Unless otherwise specified, the expression of "part(s)" and "%" means that by mass, representing a value not in terms of solid content.

Example 1

As a substrate, a 5-μm thick long polyethylene terephthalate film which underwent easy-adhesive treatment was provided. Entirely onto one surface of this substrate, a coating liquid for back face layer 1 having the following composition was coated so as to obtain a thickness of 0.5 μm in the dried state and then the coated liquid was dried to form a back face layer. Subsequently, entirely onto the other surface of the substrate, a coating liquid for dye primer layer having the following composition was coated so as to obtain a thickness of 0.1 μm in the dried state and the coated liquid was dried to from a dye primer layer. Thus, obtained was a laminate in which the back face layer, the substrate, and the dye primer layer were layered in this order. Onto the dye primer layer of this laminate, a coating liquid for yellow dye layer, a coating liquid for magenta dye layer, and a coating liquid for cyan dye layer were each coated so as to obtain a thickness of 0.6 μm in the dried state, and the coated liquids were each dried to form a yellow dye layer (Y dye layer), a magenta dye layer (M dye layer), and a cyan dye layer (C dye layer) on the laminate, as being frame sequentially. The thermal transfer sheet of Example 1 was thus prepared.

<Coating Liquid for Back Face Layer 1>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 9.8 parts |
| polyisocyanate having an isocyanurate structure (solid content 50%) (BURNOCK(R) D-800, DIC Corporation) | 1.4 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

<Coating Liquid for Dye Primer Layer>

| | |
|---|---|
| colloidal silica (particle size 4 to 6 nm, solid content 10%) (SNOWTEX(R) OXS, Nissan Chemical Corporation) | 30 parts |
| polyvinyl pyrrolidone resin (K-90, ISP Japan Ltd.) | 3 parts |
| water | 50 parts |
| isopropyl alcohol | 17 parts |

<Coating Liquid for Yellow Dye Layer>

| | |
|---|---|
| Solvent Yellow 93 | 2.0 parts |
| Disperse Yellow 231 | 2.0 parts |
| polyvinyl acetal resin (S-LEC(R) KS-5, Sekisui Chemical Co., Ltd.) | 3.5 parts |
| polyethylene wax | 0.1 parts |
| methyl ethyl ketone | 45.0 parts |
| toluene | 45.0 parts |

<Coating Liquid for Magenta Dye Layer>

| | |
|---|---|
| disperse dye (MS Red G) | 1.5 parts |
| disperse dye (MACROLEX Red Violet R) | 2.0 parts |
| polyvinyl acetal resin (S-LEC(R) KS-5, Sekisui Chemical Co., Ltd.) | 4.5 parts |
| polyethylene wax | 0.1 parts |
| methyl ethyl ketone | 45.0 parts |
| toluene | 45.0 parts |

<Coating Liquid for Cyan Dye Layer>

| | |
|---|---|
| Solvent Blue 63 | 2.0 parts |
| Disperse Blue 354 | 2.0 parts |
| polyvinyl acetal resin (S-LEC(R) KS-5, Sekisui Chemical Co., Ltd.) | 3.5 parts |
| polyethylene wax | 0.1 parts |
| methyl ethyl ketone | 45.0 parts |
| toluene | 45.0 parts |

Example 2

A thermal transfer sheet of Example 2 was produced in the same manner as in Example 1 except that the coating liquid for back face layer 1 was replaced by a coating liquid for back face layer 2 having the following composition.

<Coating Liquid for Back Face Layer 2>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 9.8 parts |
| polyisocyanate having an isocyanurate structure (solid content 50%) (TAKENATE(R) D-268, Mitsui Chemicals, Inc.) | 1.4 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Example 3

A thermal transfer sheet of Example 3 was produced in the same manner as in Example 1 except that the coating liquid for back face layer 1 was replaced by a coating liquid for back face layer 3 having the following composition.

<Coating Liquid for Back Face Layer 3>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 9.8 parts |
| polyisocyanate having an isocyanurate structure (solid content 50%) (TAKENATE(R) D-262, Mitsui Chemicals, Inc.) | 1.5 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Example 4

A thermal transfer sheet of Example 4 was produced in the same manner as in Example 1 except that the coating liquid for back face layer 1 was replaced by a coating liquid for back face layer 4 having the following composition.

<Coating Liquid for Back Face Layer 4>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 9.8 parts |
| polyisocyanate having an isocyanurate structure (solid content 50%) (TAKENATE(R) D-204EA, Mitsui Chemicals, Inc.) | 1.5 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Example 5

A thermal transfer sheet of Example 5 was produced in the same manner as in Example 1 except that the coating liquid for back face layer 1 was replaced by a coating liquid for back face layer 5 having the following composition.

<Coating Liquid for Back Face Layer 5>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 9.9 parts |
| polyisocyanate having an isocyanurate structure (TAKENATE(R) D-170, Mitsui Chemicals, Inc.) | 0.5 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |

-continued

| molar equivalent ratio (—NCO/—OH):0.1 | |
|---|---|
| inorganic particles (MICRO ACE(R) P3, Nippon Talc Co., Ltd.) | 1.2 parts |
| methyl ethyl ketone | 55.0 parts |
| toluene | 27.5 parts |

Example 6

A thermal transfer sheet of Example 6 was produced in the same manner as in Example 1 except that the coating liquid for back face layer 1 was replaced by a coating liquid for back face layer 6 having the following composition.

<Coating Liquid for Back Face Layer 6>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 9.9 parts |
| polyisocyanate having an isocyanurate structure (Coronate(R) HX, Tosoh Corporation) | 0.5 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Example 7

A thermal transfer sheet of Example 7 was produced in the same manner as in Example 1 except that the coating liquid for back face layer 1 was replaced by a coating liquid for back face layer 7 having the following composition.

<Coating Liquid for Back Face Layer 7>

| molar equivalent ratio (—NCO/—OH):0.05 | |
|---|---|
| polyvinyl acetal resin (hydroxyl value 12% by mass) (S-LEC(R) KS-1, Sekisui Chemical Co., Ltd.) | 9.8 parts |
| polyisocyanate having an isocyanurate structure (solid content 50%) (TAKENATE(R) D-262, Mitsui Chemicals, Inc.) | 0.7 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Example 8

A thermal transfer sheet of Example 8 was produced in the same manner as in Example 1 except that the coating liquid for back face layer 1 was replaced by a coating liquid for back face layer 8 having the following composition.

<Coating Liquid for Back Face Layer 8>

| molar equivalent ratio (—NCO/—OH):0.15 | |
|---|---|
| polyvinyl acetal resin (hydroxyl value 12% by mass) (S-LEC(R) KS-1, Sekisui Chemical Co., Ltd.) | 9.8 parts |
| polyisocyanate having an isocyanurate structure (solid content 50%) (TAKENATE(R) D-262, Mitsui Chemicals, Inc.) | 2.2 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Example 9

A thermal transfer sheet of Example 9 was produced in the same manner as in Example 1 except that the coating liquid for back face layer 1 was replaced by a coating liquid for back face layer 9 having the following composition.

<Coating Liquid for Back Face Layer 9>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 9.9 parts |
| polyisocyanate having an isocyanurate structure (solid content 50%) (TAKENATE(R) D-268, Mitsui Chemicals, Inc.) | 1.4 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Comparative Example 1

A thermal transfer sheet of Comparative Example 1 was produced in the same manner as in Example 1 except that the coating liquid for back face layer 1 was replaced by a coating liquid for back face layer A having the following composition.

<Coating Liquid for Back Face Layer A>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 9.9 parts |
| polyisocyanate having an isocyanurate structure (solid content 75%) (TAKENATE(R) D-127N, Mitsui Chemicals, Inc.) | 0.8 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |

-continued

| molar equivalent ratio (—NCO/—OH):0.1 | |
|---|---|
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Comparative Example 2

A thermal transfer sheet of Comparative Example 2 was produced in the same manner as in Example 1 except that the coating liquid for back face layer 1 was replaced by a coating liquid for back face layer B having the following composition.

<Coating Liquid for Back Face Layer B>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 9.9 parts |
| polyisocyanate in an adduct form (solid content 75%) (BURNOCK(R) D-750, DIC Corporation) | 0.9 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Comparative Example 3

A thermal transfer sheet of Comparative Example 3 was produced in the same manner as in Example 1 except that the coating liquid for back face layer 1 was replaced by a coating liquid for back face layer C having the following composition.

<Coating Liquid for Back Face Layer C>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 9.9 parts |
| polyisocyanate in an adduct form (solid content 71%) (TAKENATE(R) D-103M2, Mitsui Chemicals, Inc.) | 1.0 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Comparative Example 4

A thermal transfer sheet of Comparative Example 4 was produced in the same manner as in Example 1 except that the coating liquid for back face layer 1 was replaced by a coating liquid for back face layer D having the following composition.

<Coating Liquid for Back Face Layer D>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 10.0 parts |
| polyisocyanate in an adduct form (solid content 75%) (TAKENATE(R) D-110N, Mitsui Chemicals, Inc.) | 1.0 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Comparative Example 5

A thermal transfer sheet of Comparative Example 5 was produced in the same manner as in Example 1 except that the coating liquid for back face layer 1 was replaced by a coating liquid for back face layer E having the following composition.

<Coating Liquid for Back Face Layer E>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 9.9 parts |
| polyisocyanate having a biuret structure (TAKENATE(R) D-165, Mitsui Chemicals, Inc.) | 0.5 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Comparative Example 6

A thermal transfer sheet of Comparative Example 6 was produced in the same manner as in Example 1 except that the coating liquid for back face layer 1 was replaced by a coating liquid for back face layer F having the following composition.

<Coating Liquid for Back Face Layer F>

| molar equivalent ratio (—NCO/—OH):0.1 | |
|---|---|
| polyvinyl acetal resin (hydroxyl value 12% by mass) (S-LEC(R) KS-1, Sekisui Chemical Co., Ltd.) | 9.9 parts |
| polyisocyanate in an adduct form (solid content 75%) (TAKENATE(R) D-160, Mitsui Chemicals, Inc.) | 0.9 parts |
| zinc stearyl phosphate (LBT1830 purified, Sakai Chemical Industry Co., Ltd.) | 2.1 parts |

-continued

| molar equivalent ratio (—NCO/—OH):0.1 | |
|---|---|
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Comparative Example 7

A thermal transfer sheet of Comparative Example 7 was produced in the same manner as in Example 1 except that the coating liquid for back face layer 1 was replaced by a coating liquid for back face layer G having the following composition.

<Coating Liquid for Back Face Layer G>

| | |
|---|---|
| polyvinyl acetal resin (hydroxyl value 12% by mass) (S-LEC(R) KS-1, Sekisui Chemical Co., Ltd.) | 10.4 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Comparative Example 8

A thermal transfer sheet of Comparative Example 8 was produced in the same manner as in Example 1 except that the coating liquid for back face layer 1 was replaced by a coating liquid for back face layer H having the following composition.

<Coating Liquid for Back Face Layer H>

| molar equivalent ratio (—NCO/—OH):0.01 | |
|---|---|
| polyvinyl acetal resin (hydroxyl value 12% by mass) (S-LEC(R) KS-1, Sekisui Chemical Co., Ltd.) | 10.4 parts |
| polyisocyanate having an isocyanurate structure (solid content 50%) (TAKENATE(R) D-262, Mitsui Chemicals, Inc.) | 0.2 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 55.0 parts |
| toluene | 27.5 parts |

Comparative Example 9

A thermal transfer sheet of Comparative Example 9 was produced in the same manner as in Example 1 except that the coating liquid for back face layer 1 was replaced by a coating liquid for back face layer 1 having the following composition.

<Coating Liquid for Back Face Layer I>

| molar equivalent ratio (—NCO/—OH):0.2 | |
|---|---|
| polyvinyl acetal resin (hydroxyl value 12% by mass) (S-LEC(R) KS-1, Sekisui Chemical Co., Ltd.) | 9.1 parts |
| polyisocyanate having an isocyanurate structure solid content 50%) (TAKENATE(R) D-262, Mitsui Chemicals, Inc.) | 2.8 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 54.0 parts |
| toluene | 27.0 parts |

Comparative Example 10

A thermal transfer sheet of Comparative Example 10 was produced in the same manner as in Example 1 except that the coating liquid for back face layer 1 was replaced by a coating liquid for back face layer J having the following composition.

<Coating Liquid for Back Face Layer J>

| molar equivalent ratio (—NCO/—OH):0.5 | |
|---|---|
| polyvinyl acetal resin (hydroxyl value 12% by mass) (S-LEC(R) KS-1, Sekisui Chemical Co., Ltd.) | 7.6 parts |
| polyisocyanate having an isocyanurate structure (solid content 50%) (TAKENATE(R) D-262, Mitsui Chemicals, Inc.) | 5.8 parts |
| zinc stearyl phosphate (LBT1830 purified, Sakai Chemical Industry Co., Ltd.) | 2.1 parts |
| zinc stearate (SZ-PF, Sakai Chemical Industry Co., Ltd.) | 2.1 parts |
| polyethylene wax (Polywax 3000, TOYO ADL CORPORATION) | 0.6 parts |
| ethoxylated alcohol-modified wax (Unithox 750, TOYO ADL CORPORATION) | 1.4 parts |
| inorganic particles (MICRO ACE(R) P3, Nippon Talc Co., Ltd.) | 1.2 parts |
| methyl ethyl ketone | 53.0 parts |
| toluene | 26.5 parts |

(Kick Evaluation)

The magenta portion of a genuine ribbon for a sublimable type transfer printer (DS620, Dai Nippon Printing Co., Ltd.) was opposed to a film prepared by coating only the back face layer of the thermal transfer sheet of each of Examples and Comparative Examples. Under a load of 1.96 MPa, the magenta portion and the film was stored under an environment of 40° C. and a humidity of 90% for 96 hours to allow the dye to migrate (so-called be kicked) to the back face layer of the thermal transfer sheet of each of Examples and Comparative Examples. The hue of the transferred portion of each back face layer subjected to kicking was measured by use of a spectrometer, Spectrolino (X-Rite Inc.) (D65 light source, view angle 2°). The color difference ΔE* between an unstored film including only the back face layer coated and the film including only the back face layer coated and having been subjected to kicking was evaluated based on the following criteria.

(Color Difference Expression (Kick Evaluation))

$$\Delta E^* = ((\text{difference between } L^* \text{ values before and after opposition})^2 + (\text{difference between } a^* \text{ values before and after opposition})^2 + (\text{difference between } b^* \text{ values before and after opposition})^2)^{1/2}$$

Incidentally, the L*a*b* means the L*a*b* specified in CIE1976, L*a*b* color system (JISZ8729 (published in 1980)).

(Evaluation Criteria (Kick Evaluation))

A: The color difference ΔE* is less than 8.5.

B: The color difference ΔE* is 8.5 or more and less than 10.0.

NG-1: The color difference ΔE* is 10.0 or more and less than 11.5.

NG-2: The color difference ΔE* is 11.5 or more.

(Aging Evaluation)

A portion of a genuine ribbon for a sublimable type transfer printer (DS620, Dai Nippon Printing Co., Ltd.) was replaced by a film prepared by storing (aging) the thermal transfer sheet of each of Examples and Comparative Examples under an environment of 50° C. and a humidity of 30%, and then, 10 prints of a black solid image (0/255 image gray scale) were printed. Among 10 prints, the aging time until no printing failures (so-called printing wrinkles) due to twists and warps of the film during printing no longer occurred was evaluated based on the following criteria.

(Evaluation Criteria (Aging Evaluation))

A: The aging time is less than 20 hours.

B: The aging time is 20 hours or more and less than 35 hours.

NG-1: The aging time is 35 hours or more and less than 50 hours.

NG-2: The aging time is 50 hours or more.

(Evaluation for Adhesion of Residues Onto Thermal Head)

The film portion of a 5-inch-size genuine ribbon for a sublimable type transfer printer (DS620, Dai Nippon Printing Co., Ltd.) was replaced by a film prepared by storing (aging) the thermal transfer sheet of each of Examples and Comparative Examples under an environment of 23° C. and a humidity of 50% for two weeks, and then, 200 prints of a black solid image (0/255 image gray scale) were printed. The vicinity of the heating element of the thermal head of the printer after printing was observed with a digital microscope VHX-2000 (KEYENCE CORPORATION), and the amount of residues adhering was evaluated based on the following criteria.

(Evaluation Criteria (Evaluation for Adhesion of Residues Onto Thermal Head))

A: No residue adheres.

B: Substantially no residue adheres.

C: Residues adhere, but there is no problem in practical use.

NG-1: Residues adhere, which results in a problem in practical use.

NG-2: A large amount of residues adheres, which results in a problem in practical uses.

(Evaluation Results)

The evaluation results are each summarized in Table 1 below.

TABLE 1

| | Structure of polyisocyanate | Equivalents of isocyanate groups | Content of inorganic particles (%) | Kick evaluation | Aging evaluation | Evaluation for adhesion of residues |
|---|---|---|---|---|---|---|
| Example 1 | Nurate | 0.1 | 5 | B | A | A |
| Example 2 | Nurate | 0.1 | 5 | B | A | A |
| Example 3 | Nurate | 0.1 | 5 | B | A | A |
| Example 4 | Nurate | 0.1 | 5 | B | A | A |
| Example 5 | Nurate | 0.1 | 5 | B | B | B |
| Example 6 | Nurate | 0.1 | 5 | B | B | B |
| Example 7 | Nurate | 0.05 | 5 | B | A | C |
| Example 8 | Nurate | 0.15 | 5 | B | B | B |
| Example 9 | Nurate | 0.1 | 4.5 | B | A | C |
| Comparative Example 1 | Nurate | 0.1 | 5 | NG-1 | B | B |
| Comparative Example 2 | Adduct | 0.1 | 5 | NG-1 | B | A |
| Comparative Example 3 | Adduct | 0.1 | 5 | NG-1 | B | A |
| Comparative Example 4 | Adduct | 0.1 | 5 | NG-1 | B | B |
| Comparative Example 5 | Biuret | 0.1 | 5 | NG-1 | B | B |
| Comparative Example 6 | Adduct | 0.1 | 5 | NG-1 | B | B |
| Comparative Example 7 | — | — | 5 | NG-2 | — | A |
| Comparative Example 8 | Nurate | 0.01 | 5 | NG-1 | A | A |
| Comparative Example 9 | Nurate | 0.2 | 5 | B | NG-1 | NG-1 |
| Comparative Example 10 | Nurate | 0.5 | 5 | A | NG-2 | NG-2 |

It can be seen also from Table 1 that the thermal transfer sheets according to Examples of the present invention are superior to those of Comparative Examples.

REFERENCE SIGNS LIST

10 Thermal transfer sheet
1 Substrate
2 Colorant layer
3 Back face layer

The invention claimed is:

1. A thermal transfer sheet comprising;

a colorant layer located on one surface of a substrate and a back face layer located on the other surface of the substrate, wherein the back face layer comprises a binder resin and inorganic particles, and the binder resin comprises a product obtained by reacting a polyisocyanate having an isocyanurate structure with a resin having hydroxyl groups at an equivalent ratio of isocyanate groups in the polyisocyanate having an isocyanurate structure to hydroxyl groups in the resin having hydroxyl groups (—NCO/—OH) of 0.05 or more and 0.15 or less.

2. The thermal transfer sheet according to claim 1, wherein the polyisocyanate having an isocyanurate structure is a polyisocyanate obtained by polymerizing isocyanate monomers with a cyclic structure having 9 or more carbon atoms.

3. The thermal transfer sheet according to claim 1, wherein the inorganic particles are non-spherical inorganic particles and are contained at 5% by mass or more on the basis of the total mass of the back face layer.

4. The thermal transfer sheet according to claim 2, wherein the inorganic particles are non-spherical inorganic particles and are contained at 5% by mass or more on the basis of the total mass of the back face layer.

* * * * *